US005425146A

United States Patent [19]

Serrano

[11] Patent Number: 5,425,146

[45] Date of Patent: Jun. 20, 1995

[54] ADAPTABLE ASSEMBLY FOR A SOAPY WATER OPERATED TOILET SYSTEM

[76] Inventor: Fabian A. Serrano, Sierra Chalchihui No. 235, Torre A-402, Col. Lomas de Chapultepec, 110, Mexico

[21] Appl. No.: 250,020

[22] Filed: May 27, 1994

Related U.S. Application Data

[60] Division of Ser. No. 997,762, Dec. 24, 1992, Pat. No. 5,341,529, which is a continuation-in-part of Ser. No. 788,221, Nov. 5, 1991, abandoned.

[51] Int. Cl.[6] ..... A47K 4/00

[52] U.S. Cl. ..... 4/665

[58] Field of Search ..... 4/353, 363, 665

[56] References Cited

U.S. PATENT DOCUMENTS

| | | | |
|---|---|---|---|
| 3,318,449 | 5/1967 | Jennings | 4/665 |
| 4,371,992 | 2/1983 | Rivera | 4/353 |
| 4,924,536 | 5/1990 | Houghton | 4/665 |
| 5,106,493 | 4/1992 | McIntosh | 4/665 X |

FOREIGN PATENT DOCUMENTS

| | | | |
|---|---|---|---|
| 0427213 | 5/1991 | European Pat. Off. | 4/665 |
| 2336744 | 6/1975 | Germany | 4/665 |
| 3434267 | 3/1986 | Germany | 4/665 |
| 4037389 | 5/1992 | Germany | 4/665 |
| 0300427 | 12/1990 | Japan . | |

*Primary Examiner*—Charles E. Phillips
*Attorney, Agent, or Firm*—Ladas & Parry

[57] ABSTRACT

A system designed for approaching the soapy water being collected in a shower, or other sources for operating the discharge or flushing of the toilet. To this end, the system comprises an auxiliary tank for containing the collected soapy water and the necessary installation for supplying said water first to said auxiliary tank and then from the latter to the primary tank associated with said toilet. The system further comprises a special fixture assembly adapted to be disposed on the primary water storge tank, according to a first embodiment, between the uppermost end thereof and the cover of said tank.

6 Claims, 5 Drawing Sheets

ADAPTABLE ASSEMBLY FOR A SOAPY WATER OPERATED TOILET SYSTEM

This is a divisional of application Ser. No. 07/997,762, filed Dec. 24, 1992, now U.S. Pat. No. 5,341,529 which is a continuation-in-part of application Ser. No. 07/788,221 filed Nov. 5, 1991 now abandoned.

FILED OF THE INVENTION

The invention relates to a system adapted to operate with soapy water collected from accumulation sites and particularly an assembly designed for providing a soapy water flow communication between an auxiliary tank and the primary tank of a toilet.

BACKGROUND OF THE INVENTION

In the matter of saving of potable water a lot of systems are already known which take advantage of the water used in the showers, baths, sinks and the like by using different means to reuse the soapy water to operate the discharge of the toilet. Nevertheless, all of the known systems are designed in such a complicated manner that the installation thereof makes necessary the conventional toilets to be replaced completely, therefore such system are not manufactured. In other words, the systems patented so far are not capable of being adapted at least in part to the structure already existing in homes, sport centers, restaurants, hotels, etc.

The foregoing circumstance makes it difficult for the user to undertake any replacement of the conventional installation as none of the patented water systems are on the market. Of course, it is not meant herein that such novel systems are impractical, because they may satisfy in general the aim for which they were invented: saving the potable water by re-using the soapy water to operate toilets. However, it must be mentioned that such systems do not provide the utilization of at least a part of the conventional system installed, that is, the usual toilet tank is replaced due to the complex mechanism proposed in said systems.

SUMMARY OF THE INVENTION

An object of the invention is to provide a water saving system of the type using the soapy water collected from accumulation sites such as whowers, sinks, tubs and the like and which comprises an assembly by which the conventional toilets do not require any modification in their structure to have installed the water saving system.

In accordance with the invention, the conventional toilets are converted into a system for operating with soapy water by providing an auxiliary tank disposed above the primary tank and being supplied with soapy water collected, for example, in the shower, tub, sink and the like, using therefor a pumping means and the necessary piping to provide a flow communication between the water accumulation site and the auxiliary tank and between the latter and the primary tank of the toilet.

One of the most important features of the invention consists in an assembly specially designed to avoid the primary tank from being modified, said assembly comprising a fixture being adapted to be interposed between the uppermost end of the tank and the cover thereof. In a first embodiment, the fixture consists in a frame having a pair of opposed longitudinal sidepieces and a pair of opposed traverse sidepieces connected to each other to form a frame having the same size as the upper portion or lid of the tank so as to be seated thereon. In a second embodiment, the fixture consists in a new cover member characterized by having a central region with a height slightly greater than that of the conventional cover of the tank.

The fixture as made in any of the two aforedescribed embodiments is provided with two orifices, one for receiving a hose communicating with both tanks and through which the soapy water exceeding a predetermined level in the auxiliary tank passes to the primary tank. The other one to receive the tubular member by which the soapy water is supplied to the primary tank from the auxiliary tank.

In accordance with the invention, three new different types of floating elements are also provided to facilitate the operation of the toilet. Each embodiment includes a pair of arms parallel to each other and at the end of which at least a floating member is secured. Such arms can be straight or curvilinear.

DETAILED DESCRIPTION OF THE PREFERRED EMBODIMENTS

Figure 1:
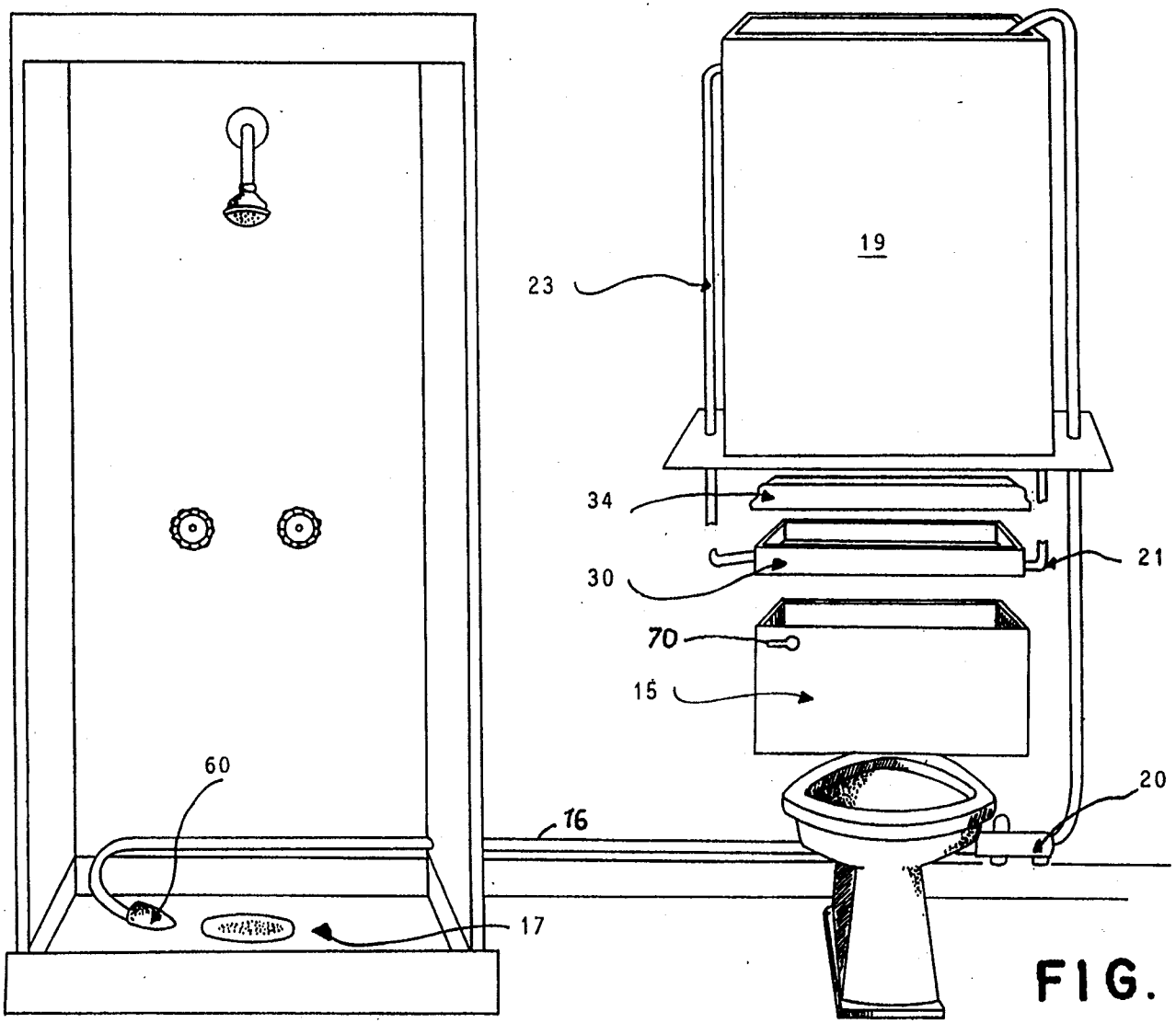
FIG. 1, is a general view of the complete water saving system including the main embodiment of the adaptable assembly.

Referring to FIG. 1, the system comprises a toilet 10 having a primary tank 15 which operates the discharge of the toilet by using clean water being supplied to it by conventional means. The toilet is, however, connected to a water saving system comprising a site 17 for accumulation of water previously used in a shower or tub, for example, a second or auxiliary tank 19 located above the primary tank 15, although not necessarily immediately above tank 15, and a pipe assembly which extends from said accumulation site 17 to the auxiliary tank 19 in order to convey the soapy water collected in site 17 to tank 19 by means of a pumping element 20.

To operate the primary tank 15 with the collected soapy water, pipe elements 21, 23 are disposed to connect in flow communication the auxiliary and primary tanks. Element 21 serves to supply the lower tank 15 with the soapy water while element 23 acts as a relieving means for permiting water exceeding a predetermined level in said tank 19 to pass into the primary tank 15. When the toilet is to be operated by soapy water, the supply of clean water may be interrupted.

Although a system having a construction similar to that described in FIG. 1 has been already proposed in Japanese patent No. 2-300427, such system requires one to replace completely the primary tank of the toilet.

One important feature of the invention consists in providing a new arrangement whose use does not require either removing the existing installation specialized personnel for adapting the same to the toilet. Such an arrangement appears in FIGS. 2 and 3 and comprises a frame 30 which is to be positioned on the upper end of the primary tank by means of a flange 32 extending outwardly and downwardly from the frame body to form a seat section which accommodates said upper end of tank 15. The conventional cover 34 of tank 15 rests on frame 30 to maintain said tank closed.

Figure 6:
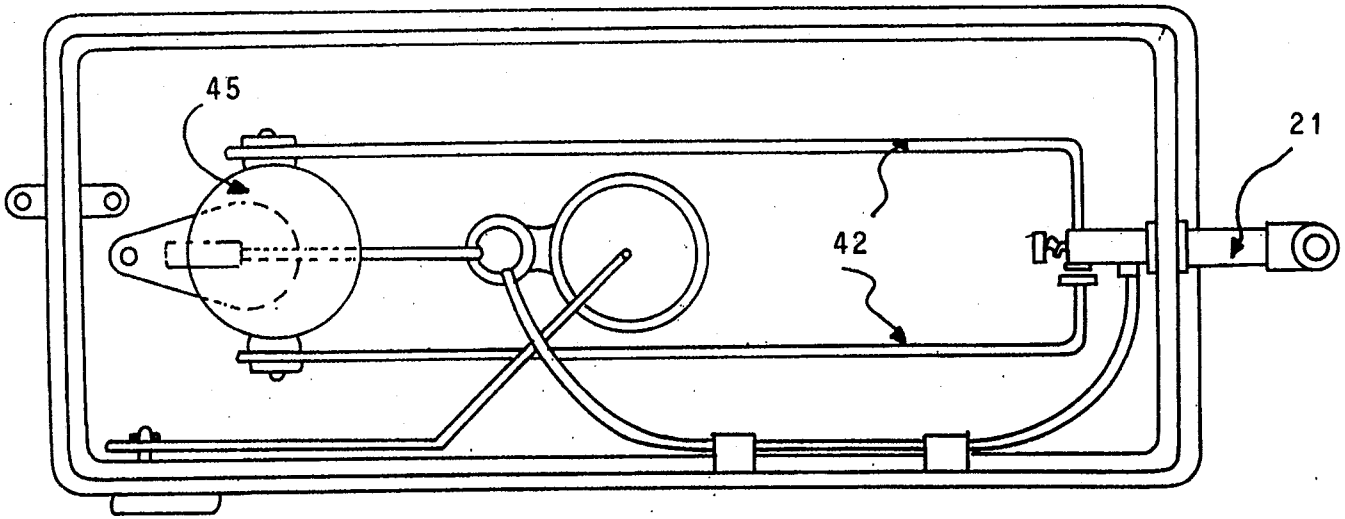
FIG. 6, is a top view of the primary tank showing a special design of the float assembly for the water saving system.

Frame 30 has a first opening 36 in which is connected pipe element 21 for the supply of soapy water from the auxiliary tank 19 to said tank 15 and a second opening 38 to receive the pipe element 23 through which the excess water passes to said primary tank. In addition, a float assembly 40 is provided to operate more efficiently the toilet, said assembly being fastened to the frame 30 and comprises a pair of arms 42 extending straight an parallel to each other, at the end of each of which is attached a float element 44 of any appropriate shape. As in conventional toilets, the float element 44 operates a valve 46 to close the flow of water into the primary tank 15 when the water reaches a predetermined level in the tank 15. The construction of the valve 46 to control flow of inlet water into tank 15 via tube 47 is conventional. FIG. 6 shows a single float element 45 entrapped between the extremities of arm 42 and in another alternative shown in FIG. 2, said arms 42 are curved i.e. provided with a bend 48 so that the assembly 40 occupies a small area within the primary tank for small size tanks as shown in FIG. 2.

Figure 2:
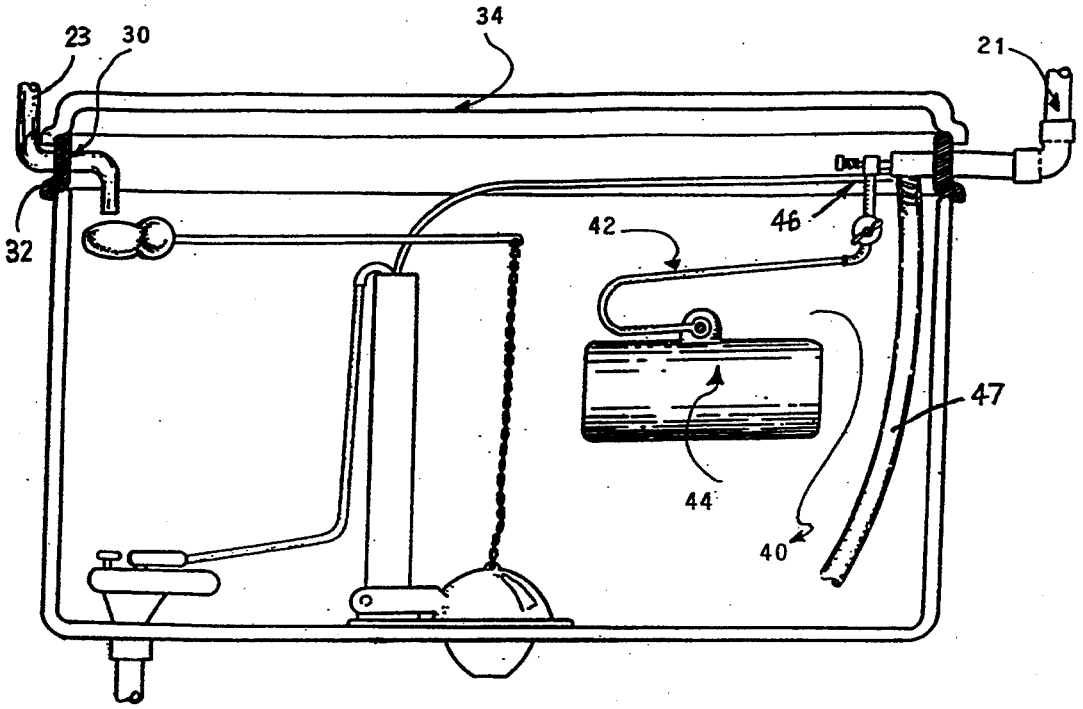
FIG. 2, is a front view of the sectioned primary tank using the new frame to receive the pipe members connecting the auxiliary tank with the primary tank.
Figure 3:
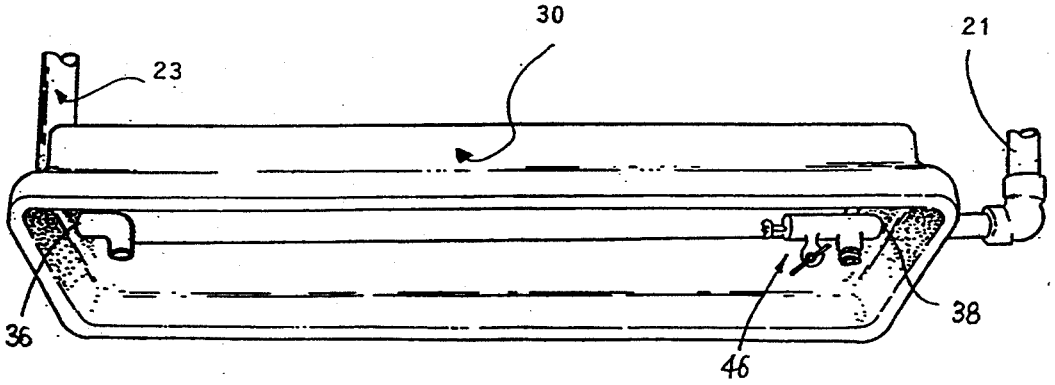
FIG. 3, is a bottom perspective view of the adaptable frame placed between the upper end or lid of the tank and the cover thereof.

As observed in FIGS. 1 and 2, the aforedescribed embodiment is of rather simple manufacture and the most important characteristic thereof is that, as distinguished from the known systems, the adaptable frame 30 is simply placed on the upper end of the primary tank, with or without a fastening element such as silicone etc., which needs not to be modified, and further acts as a support for the cover 34 which does not require any modification in order to be seated properly on said frame. Thus, a water saving system is readily obtained at a minimum cost from a conventional toilet. The conventional flushing lever 70 and its associated operating parts remain unaffected in the primary tank as evident from FIGS. 2.

Figure 5:
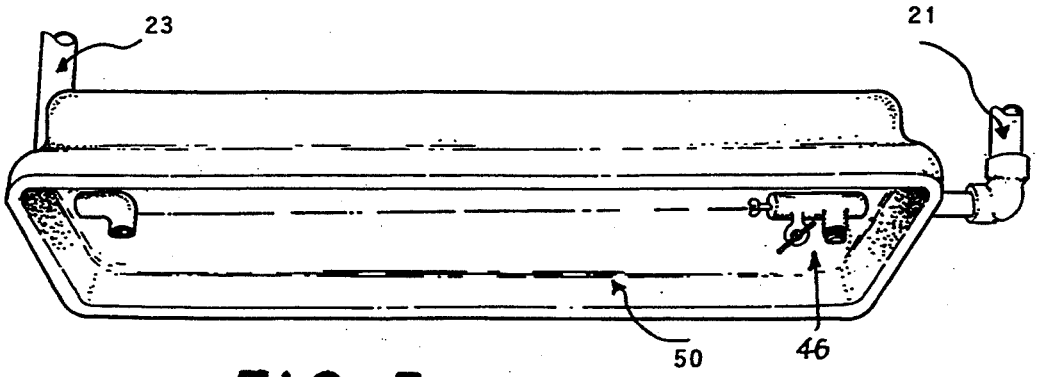
FIG. 5, is a bottom perspective view of the new cover for the primary tank shown in FIG. 4.
Figure 4:
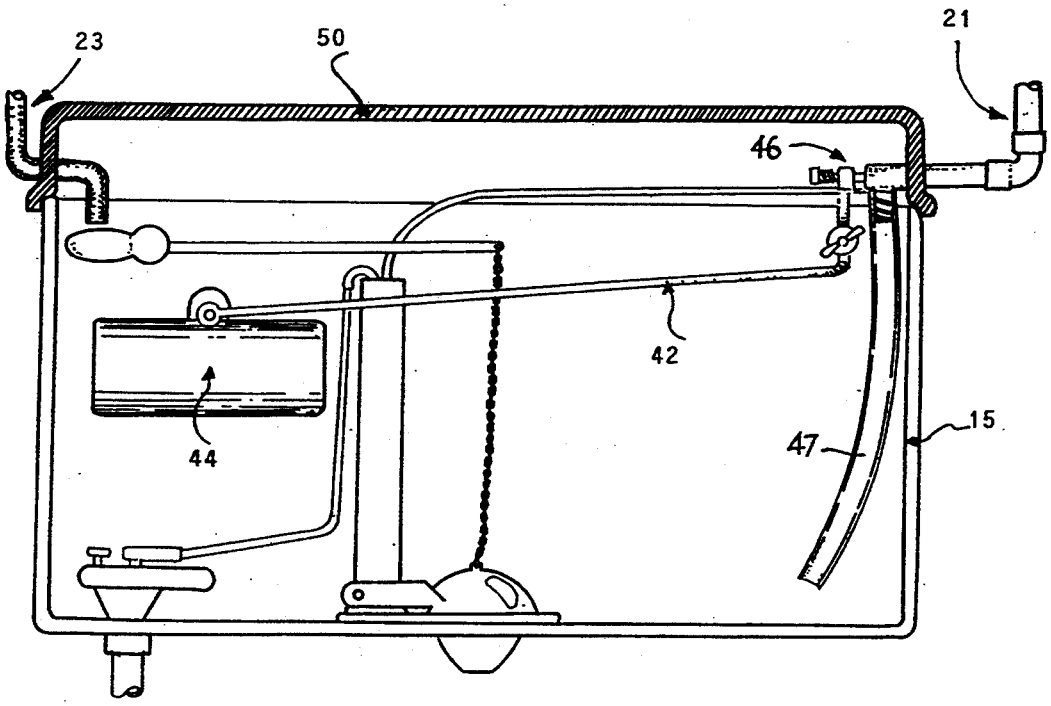
FIG. 4, is a front view of the sectioned primary tank using a new design of cover whose sides are of sufficient size as to provide the inlet opening for the soapy water pipe members.

Referring now to FIGS. 4 and 5, a second embodiment of a water saving system with minimum changes in the installation in conventional toilets is depicted therein. The "substantial" modification in FIGS. 4 and 5 is related only to the cover 50 of the primary tank 15 which replaces the original cover and is designed in such a manner that the height of said cover 50 is slightly greater than that of the original cover. The reason for the higher cover is to have the necessary surface to form therein the first and second openings 36, 38 included in the firstly described embodiment for the purposes already mentioned hereinabove. The use of this latter cover 50 avoids the use of an additional frame 30, said cover 50 being seated directly on the tank 15.

Even if the second embodiment requires one to replace the conventional cover of the toilet for a new one with the features described above, the cost involved in purchasing the new cover 50 is much less in comparison with the replacement of the complete primary tank as in any of the systems patented to date.

Figure 7:
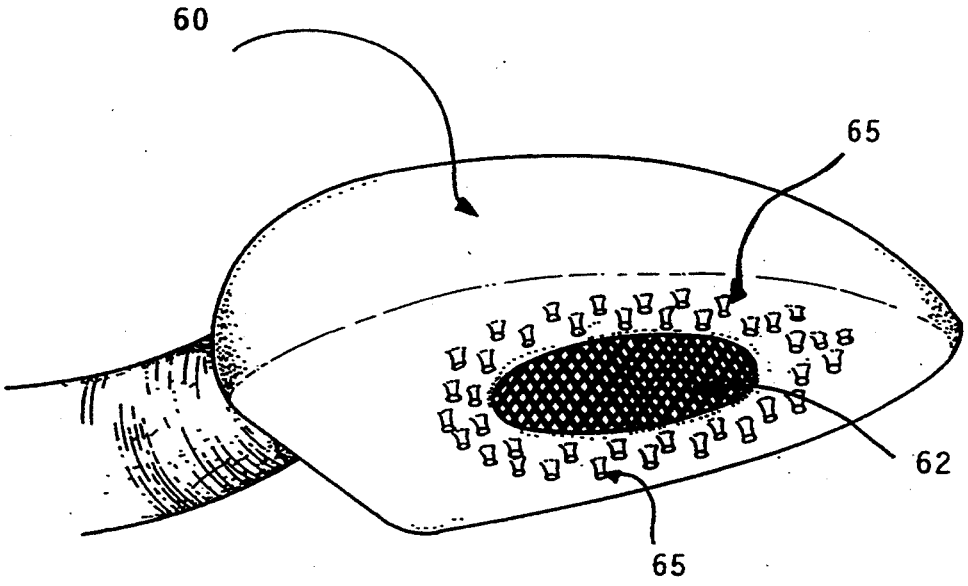
FIG. 7, is a perspective view of the water admission means to be disposed at the accumulation site.

Another proposal of the invention consists in an inlet means 60 (FIG. 7) to be placed at the accumulation site and being connected to the pipe 16 to convey the soapy water to said tank 19. Means 60 comprises a plurality of depending legs 65 disposed at the bottom thereof in such a manner as to avoid hair or any other residual material from reaching filter element 62 provided in said means 60.

From the preceding description, it will be concluded that the new system offers a greater possibility for convincing people to instal a water saving system because the cost for converting the common toilet into a system operating with recycled soapy water is really low compared to the expenditure estimated to install one of the unknown systems.

What is claimed is:

1. In a system for saving water by recycling soapy water collected at an accumulation site for flushing a toilet, said system comprising a primary tank coupled to a toilet bowl and an auxiliary tank disposed above the primary tank and communicating with the latter to supply the primary tank with soapy water, a first pipe to convey the soapy water from the accumulation site to the auxiliary tank and a second pipe to supply the soapy water from said auxiliary tank to the primary tank, a pumping element disposed in the first pipe to pump the soapy water to the auxiliary tank, the improvement comprising:

a) a cover freely and removably disposed on an upper end of the primary tank and having an enlarged upper portion for providing thereon a surface including a first opening arranged to receive one end of said second pipe coming from the auxiliary tank to supply the primary tank with soapy water and a second opening arranged to receive one end of a relief pipe by which water exceeding a predetermined level in the auxiliary tank passes to said primary tank; and b) a float assembly fastened to said cover and comprising a pair of arms extending parallel to each other and at least one float element attached to said arms.

2. The water saving system of claim 1, wherein the float element comprises a member secured to an extremity of each arm.

3. The water saving system of claim 1, wherein the float element comprises a hollow body secured by and between extremities of said arms.

4. The water saving system of claim 1, comprising valve means in said primary tank connected to said second pipe for controlling supply of soapy water to said primary tank, and wherein the arms extend straight from the valve means at one side wall of the primary tank towards an opposits side wall of the primary tank.

5. The water saving system of claim 1, wherein the arms include a bend therein so that the float assembly occupies a limited area of the primary tank.

6. The water saving system of claim 1, further including inlet means located at the accumulation site including an inlet body with a plurality of depending legs.

* * * * *